US012768140B2

(12) United States Patent
Li et al.

(10) Patent No.: US 12,768,140 B2
(45) Date of Patent: Oct. 20, 2026

(54) EXCAVATOR START-STOP CONTROL SYSTEM AND CONTROL METHOD THEREOF

(71) Applicant: Xuzhou XCMG Excavator Machinery Co., Ltd., Jiangsu (CN)

(72) Inventors: Yadong Li, Jiangsu (CN); Jiawen Geng, Jiangsu (CN); Yuzhong Dong, Jiangsu (CN); Yang Liu, Jiangsu (CN); Yang Zhang, Jiangsu (CN); Meng Wen, Jiangsu (CN); Feifei Zhao, Jiangsu (CN); Yuhang Zhu, Jiangsu (CN); Zhao Yu, Jiangsu (CN); Bingjie Zhou, Jiangsu (CN); Dongyang Du, Jiangsu (CN); Rui Zhang, Jiangsu (CN); Cunkun Jia, Jiangsu (CN)

(73) Assignee: Xuzhou XCMG Excavator Machinery Co., Ltd., Jiangsu (CN)

( * ) Notice: Subject to any disclaimer, the term of this patent is extended or adjusted under 35 U.S.C. 154(b) by 30 days.

(21) Appl. No.: 18/867,440

(22) PCT Filed: May 16, 2023

(86) PCT No.: PCT/CN2023/094463
§ 371 (c)(1),
(2) Date: Nov. 20, 2024

(87) PCT Pub. No.: WO2024/021779
PCT Pub. Date: Feb. 1, 2024

(65) Prior Publication Data

US 2025/0327275 A1 Oct. 23, 2025

(30) Foreign Application Priority Data

Jul. 28, 2022 (CN) ..... 202210897398.8

(51) Int. Cl.
*E02F 9/20* (2006.01)

(52) U.S. Cl.
CPC ..... *E02F 9/2058* (2013.01)

(58) Field of Classification Search
CPC . F02D 41/042; B60R 16/033; B60R 25/1004; B60Q 7/00; B60Q 3/40;
(Continued)

(56) References Cited

U.S. PATENT DOCUMENTS 6,031,450 A * 2/2000 Huang ..... B60C 23/0488 340/447
6,160,373 A * 12/2000 Dunn ..... H02J 7/731 320/105
(Continued)

FOREIGN PATENT DOCUMENTS

CN 203546801 4/2014
CN 108583507 9/2018
(Continued)

OTHER PUBLICATIONS

"International Search Report (Form PCT/ISA/210) of PCT/CN2023/094463," mailed on Jul. 14, 2023, with English translation thereof, pp. 1-4.

*Primary Examiner* — Yuri Kan
(74) *Attorney, Agent, or Firm* — JCIPRNET

(57) ABSTRACT

An excavator start-stop control system including a main controller, an integrated switch panel, an engine starting unit, and an engine control module is provided. A switch control unit, a one-button start switch and a power supply switch are arranged on an integrated switch panel. A second output pin of the master controller is connected to the coil of the power supply relay by means of a second diode. A third output pin of the master controller controls an engine start unit by means of connecting to a coil of a start relay. The master controller is respectively connected to the engine control module and the switch control unit through buses.

11 Claims, 5 Drawing Sheets

(58) Field of Classification Search
CPC ... H02J 7/50; H02J 7/731; B60L 53/00; B60L 58/10; A01G 17/02; H01H 47/02; B60C 23/0488
See application file for complete search history.

(56) References Cited

U.S. PATENT DOCUMENTS

| | | | | |
|---|---|---|---|---|
| 11,292,405 | B2 * | 4/2022 | Schill | B60R 16/033 |
| 2008/0179908 | A1 * | 7/2008 | Haber | B60R 25/1004 296/37.6 |
| 2010/0259199 | A1 * | 10/2010 | McDermott | B60Q 7/00 315/312 |
| 2014/0091751 | A1 * | 4/2014 | Workman | H02J 7/50 320/126 |
| 2015/0318722 | A1 * | 11/2015 | Dickson | B60L 53/00 320/103 |
| 2017/0302091 | A1 * | 10/2017 | Schaedlich | B60L 58/10 |
| 2021/0362665 | A1 * | 11/2021 | Ji | B60Q 3/40 |
| 2022/0279699 | A1 * | 9/2022 | Mazzarolo | A01G 17/02 |
| 2023/0352257 | A1 * | 11/2023 | Li | H01H 47/02 |

FOREIGN PATENT DOCUMENTS

| | | |
|---|---|---|
| CN | 214363760 | 10/2021 |
| CN | 115247436 | 10/2022 |
| JP | 2011231594 | 11/2011 |

* cited by examiner

EXCAVATOR START-STOP CONTROL SYSTEM AND CONTROL METHOD THEREOF

CROSS-REFERENCE TO RELATED APPLICATION

This application is a 371 of international application of PCT application serial no. PCT/CN2023/094463, filed on May 16, 2023, which claims the priority benefit of China application no. 202210897398.8, filed on Jul. 28, 2022. The entirety of each of the above-mentioned patent applications is hereby incorporated by reference herein and made a part of this specification.

TECHNICAL FIELD

The invention relates to an excavator start-stop control system and a control method thereof, in particular to an excavator power supply and start-stop control technology, belonging to the technical field of electrical control for excavators.

DESCRIPTION OF RELATED ART

With the development and application of one-touch start systems in the automotive industry, some engineering machinery manufacturers have begun to adopt similar solutions in recent years. However, due to the numerous patents involved, there is a high risk of infringement. Some engineering machinery manufacturers have also developed their own one-touch start solutions tailored to the specific characteristics of their products.

With the advancement of electrical control technology, traditional electrical systems in excavators can no longer adequately meet the demands for informatization and intelligence. Additionally, the low level of integration in conventional electrical components has made cost design insufficient for the increasingly fierce price competition. By merging integrated, intelligent, and informational technologies, a start-stop control system for excavators can significantly boost product competitiveness.

Currently, mainstream excavator power control and engine start-stop functions are primarily managed through a key switch. After the system is shut down, the key switch enters a power-off state, making it unsuitable for applications that require the system to remain powered after a shutdown. The start-stop control in excavators relies solely on the key switch for basic operation, resulting in poor control flexibility. Some manufacturers have adopted mature one-touch start solutions used in the automotive industry, where both powering on and starting are managed with a single button. Although this solution is technically advanced, it necessitates the use of a radio frequency key, adding complexity to a control circuit and increasing system costs. Other manufacturers use a rotate-and-press integrated one-touch start module to achieve powering on, starting, and shutting down functions, where an external ring is rotated to power on, and an internal button is used for start-stop. These approaches increase the complexity of the hardware architecture of the system.

SUMMARY

In view of the shortcomings of the prior art, the invention provides an excavator start-stop control system and a control method thereof, which not only simplify the structural complexity of traditional one-touch start modules but also enable the separation of engine start-stop and power-on functions.

To achieve the above objective, the invention adopts the following technical scheme.

In an aspect, the invention provides an excavator start-stop control system, comprising a main controller, an integrated switch panel, an engine starting unit and an engine control module;

wherein the integrated switch panel is provided with a switch control unit, a one-touch start switch and a power switch, one end of the power switch is connected with a positive pole of an excavator system power supply, the other end is connected with a coil of a power supply relay through a first diode, and the other end of the power switch is also connected with a pin of the switch control unit and a first pin of the main controller;

a second output pin of the main controller is connected to the coil of the power supply relay through a second diode to control the on-off of the excavator system power supply; and a third output pin of the main controller is connected with a coil of a starting relay K2 to control the engine starting unit, and the main controller is connected with the engine control module and the switch control unit through buses respectively.

Further, a fourth output pin of the main controller is connected to the engine control module through an emergency stop switch.

Further, the integrated switch panel is further provided with a power operation indicator light, a start protection indicator light and a start operation indicator light.

Further, the power switch adopts a single-contact structure or a dual-contact redundant structure, and the adoption of the dual-contact redundant structure improves the reliability of the power switch.

Further, the system also comprises a mobile terminal which communicates with the main controller through a communication module and is used for authenticating the identity of an operator.

Further, the system also comprises an electronic monitor, the mobile terminal is connected with the main controller through the electronic monitor, and the electronic monitor is used for setting and displaying an authentication interface.

Further, the system also comprises a biometric unit, the biometric unit is integrated with the mobile terminal or the mobile terminal is connected with the main controller through the biometric unit, and the biometric unit is used for biometric identification of an identity card of the operator.

In a second aspect, the invention provides a control method of the excavator start-stop control system as described in the above technical scheme, and the control method comprises:

when the power switch is closed, the coil of the power supply relay 8 is energized, and the main controller acquires a power switch status signal; and if the status of the power switch is closed, an output of the second output pin of the main controller is equivalent to a high level of the excavator system power supply, and reaches the power supply relay 8 through the second diode D2, so that the coil of the power supply relay 8 is continuously energized.

Further, the main controller acquires the power switch status signal in the following way: if bus communication between the main controller and the switch control unit is normal, the main controller receives the power switch status signal sent by the switch control unit through the bus; and if the bus communication between the main controller and the switch control unit is abnormal, the main controller uses the first pin to acquire the power switch status signal.

Further, the method comprises: in response to the main controller determining that the status of the power switch is off, the second output pin of the main controller stops outputting the high level after a predetermined delay time, so as to control a power holding time of an excavator system after the power switch is off.

Further, the system further comprises a mobile terminal and an electronic monitor, the mobile terminal communicates with the main controller through a communication module, and the mobile terminal is used for authenticating the identity of an operator; the mobile terminal is connected with the main controller through the electronic monitor, and the electronic monitor is used for setting an authentication interface; and the method comprises:

after the excavator power system is powered on, an authentication prompt state is initiated; the authentication interface on the electronic monitor contains APP wireless authentication and password authentication based on the mobile terminal; when wireless authentication is performed for the first time, wireless communication is enabled, and the operator uses a factory password for mobile terminal pairing; after downloading an APP, the operator uses an administrator password of the mobile device to register and bind the APP to an excavator; the authentication interface allows selection between APP wireless authentication and password login authentication; additionally, the authentication interface provides an option for guest login, which limits the usage rights of the excavator.

Beneficial effects: The invention achieves intelligent power management by acquiring power switch signals and employing a retention loop, upgrading the smartness of power control;

the independent one-touch start switch allows for separate control of power-off and shutdown, enhancing adaptability in different scenarios for the start-stop function; the power switch and the one-touch start switch are highly integrated with an integrated machine switch, resulting in higher system reliability, reduced installation space, and lower costs; and it supports biometric identification and wireless authentication via mobile terminals, improving operational safety and enhancing convenience by employing parallel authentication via the APP and password permissions.

DESCRIPTION OF THE EMBODIMENTS

The invention will be further described below with reference to the accompanying drawings.

It should be noted that when an element is described as being "connected to" or "arranged on" another element, it may be directly or indirectly on another element. When an element is considered to be "connected" to another element, it may be directly or indirectly connected to another element.

In the description of the invention, it should be noted that the terms "install" and "connect" should be understood in a broad sense unless otherwise specified and defined. For example, it can be fixed connection, detachable connection or integrated connection; it can be mechanical connection or electric connection; and it can be direct connection, indirect connection through intermediate media or internal communication of two elements or interaction of two elements. For those of ordinary skill in the art, the specific meaning of the terms mentioned above in the invention should be construed to specific circumstances.

Further, the terms "first" and "second" are only used for descriptive purposes, and cannot be understood as indicating or implying relative importance or implicitly indicating the number of indicated technical features. Therefore, the features defined with "first" and "second" may include one or more of the features explicitly or implicitly. In the description of this application, "multiple" means two or more, unless otherwise specifically defined. "Several" means one or more, unless otherwise specifically defined.

Throughout the specification, references to "an embodiment" or "embodiments" mean that specific features, structures, or characteristics described in conjunction with the embodiments are included in at least one embodiment of this application. Therefore, the phrases "in one embodiment" or "in some embodiments" that appear throughout the specification do not all refer to the same embodiment. Additionally, in one or more embodiments, specific features, structures, or characteristics can be combined in any suitable manner.

Figure 1:
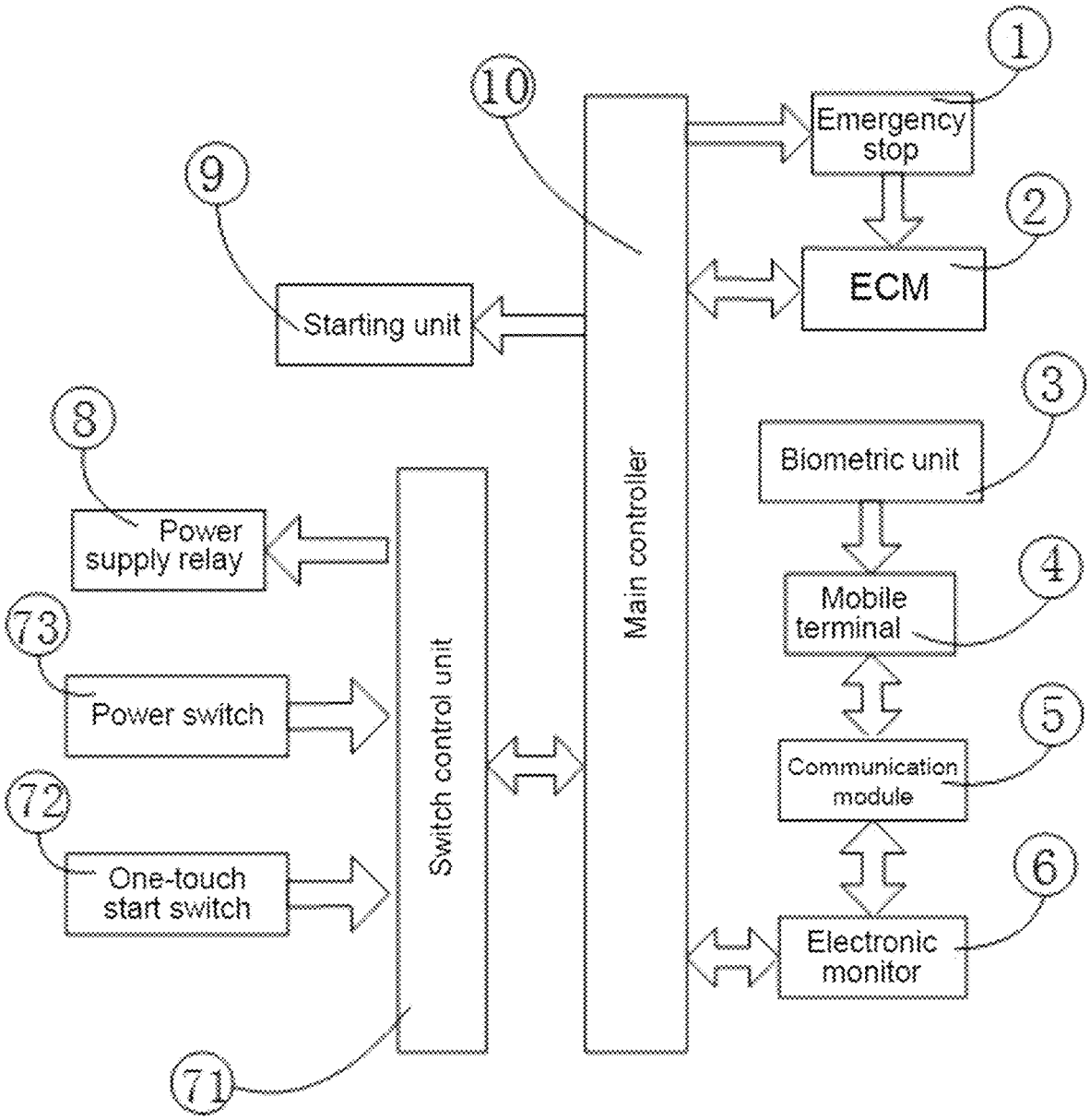
FIG. 1 is a block diagram of an excavator start-stop control system according to an embodiment of the invention.

Embodiment 1: An excavator start-stop control system, as shown in FIG. 1, comprises a main controller 10, an integrated switch panel 7, an engine starting unit 9 and an engine control module 2;

wherein the integrated switch panel 7 is provided with a switch control unit 71, a one-touch start switch 72 and a power switch 73, one end of the power switch 73 is connected with a positive pole Power+ of an excavator system power supply, the other end is connected with a coil of a power supply relay 8 (such as relay K1 in FIG. 4) through a first diode 77 (such as diode D1 in FIG. 4), and the other end of the power switch 73 is also connected with a pin of the switch control unit 71 and a first pin of the main controller 10;

a second output pin of the main controller 10 is connected to the coil of the power supply relay 8 through a second diode 78 (such as diode D2 in FIG. 4) to control the on-off of the excavator system power supply; and a third output pin of the main controller 10 is connected with a coil of a starting relay K2 to control the engine starting unit 9, and the main controller 10 is connected with the engine control module 2 (ECM) and the switch control unit 71 through buses respectively.

Alternatively, in other embodiments, a fourth output pin of the main controller 10 is connected to the engine control module 2 through an emergency stop switch 1.

Figure 2:
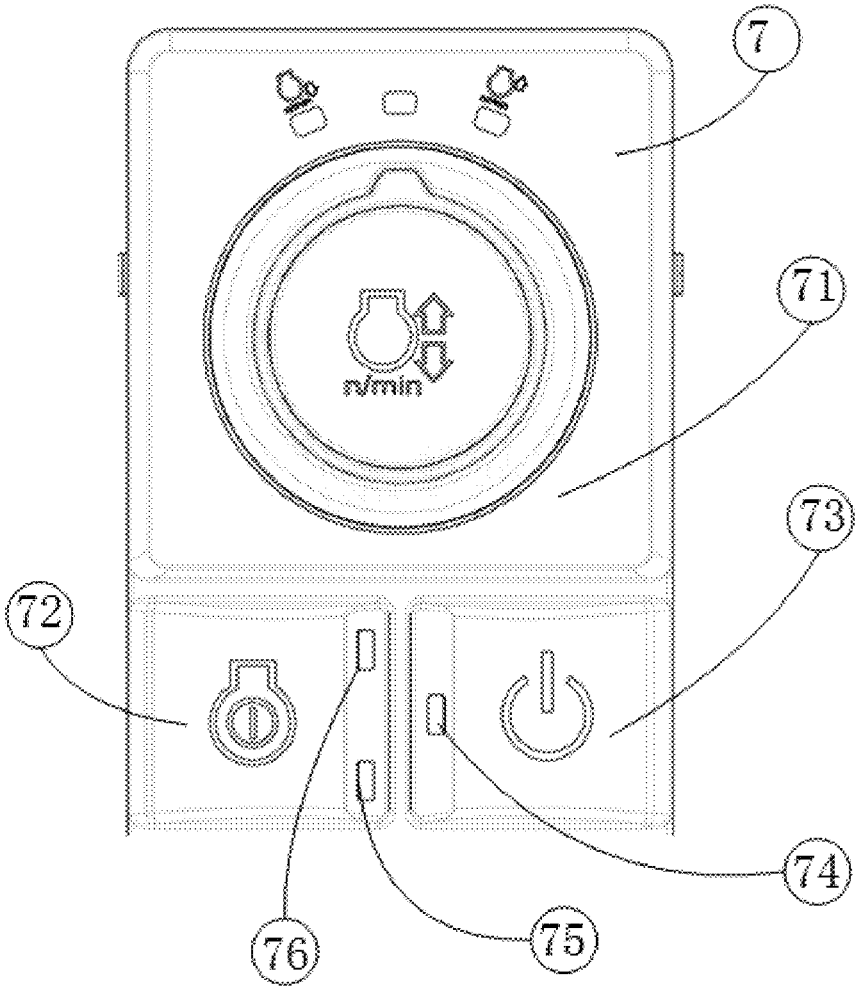
FIG. 2 is a structural and functional diagram of an integrated switch panel in an embodiment of the invention.
Figure 3:
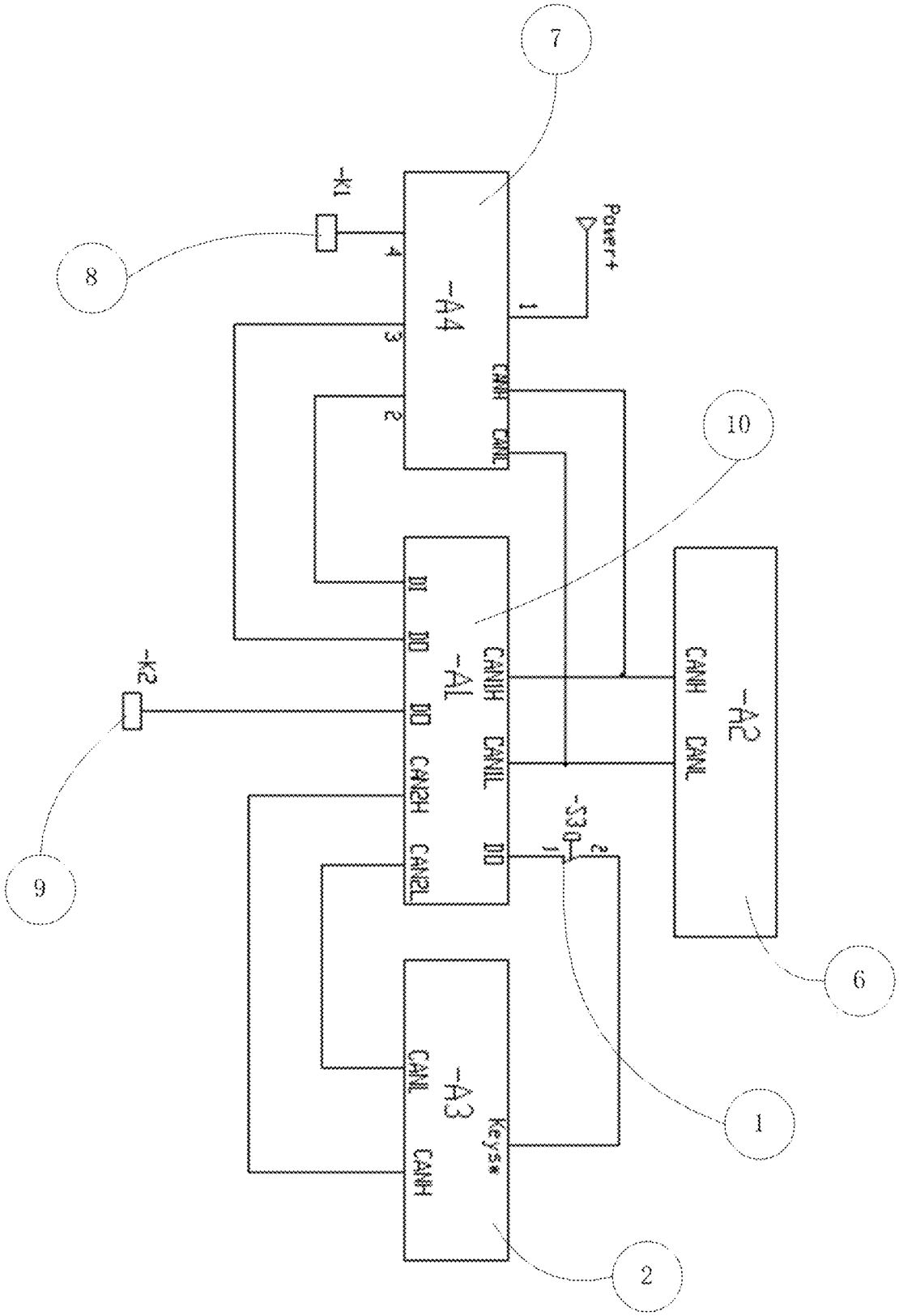
FIG. 3 is a circuit diagram according to an embodiment of the invention.

In a specific embodiment, as shown in FIG. 2, the switch control unit 71, the one-touch start switch 72 and the power switch 73 are arranged on the integrated switch panel 7, and the integrated switch panel 7 is also provided with a power operation indicator light 74, a start protection indicator light 75 and a start operation indicator light 76.

Alternatively, the system also comprises a mobile terminal 4 which communicates with the main controller 10 through a communication module 5 and is used for authenticating the identity of an operator.

The system also comprises an electronic monitor 6, the mobile terminal 4 is connected with the main controller 10 through the electronic monitor 6, and the electronic monitor 6 is used for setting an authentication interface.

Alternatively, in other embodiments, the system also comprises a biometric unit 3, the biometric unit 3 is integrated with the mobile terminal 4 or the mobile terminal 4 is connected with the main controller 10 through the biometric unit 3, and the biometric unit 3 is used for biometric identification of an identity card of the operator.

The mobile terminal 4 may be wirelessly coupled with the electronic monitor 6 through the communication module 5, the electronic monitor 6 and the integrated switch panel 7 are connected through a bus, the power supply relay 8 is electrically connected with the integrated switch panel 7, and the starting unit 9 is electrically connected with the main controller 10. In this embodiment, preferably, the mobile terminal 4 integrates the biometric unit 3 and supports mainstream Android and IOS operating systems, and biometric technologies include face identification and fingerprint identification.

Preferably, the communication module 5 may be a separate Bluetooth module or WiFi module, or a Bluetooth module or WiFi module integrated on the electronic monitor.

As shown in FIG. 2, the integrated switch panel 7 at least comprises the switch control unit 71, the one-touch start switch 72, and the power switch 73. The one-touch start switch 72 is a normally open reset button or a touch screen button. The power switch 73 is an operation button or a touch screen button.

The integrated power switch 73 of the integrated switch panel 7 may be a single-contact structure or a dual-contact redundant structure, and may be a resettable switch or a non-resettable switch. In the case of a single-contact structure, the switch control unit 71 may acquire the closed status of the single-contact switch. In the case of a dual-contact structure, the switch panel control unit may determine the closed status of the power switch 73 by acquiring the status of a redundant contact 79 of the power switch S1.

Embodiment 2: Based on Embodiment 1, this embodiment provides a control method of the excavator start-stop control system, which comprises:

when the power switch 73 is closed, the coil of the power supply relay 8 is energized, and the system power flows through the power switch 73 (S1 in FIG. 4) and the first diode 77 to the power supply relay 8, thereby activating the system power. The main controller 10 acquires a closing signal of the power switch 73 and receives the closing signal of the power switch 73 transmitted by the switch control unit 71 through a bus. The main controller 10 determines whether the bus communication is normal or not, and assesses a switch status of the power switch 73 if the bus communication is normal. If the status of the power switch 73 is closed, an output of the second output pin of the main controller 10 is equivalent to a high level of the excavator system power supply, and reaches the power supply relay 8 through the second diode 78, so that the coil of the power supply relay 8 is continuously energized.

Figure 4:
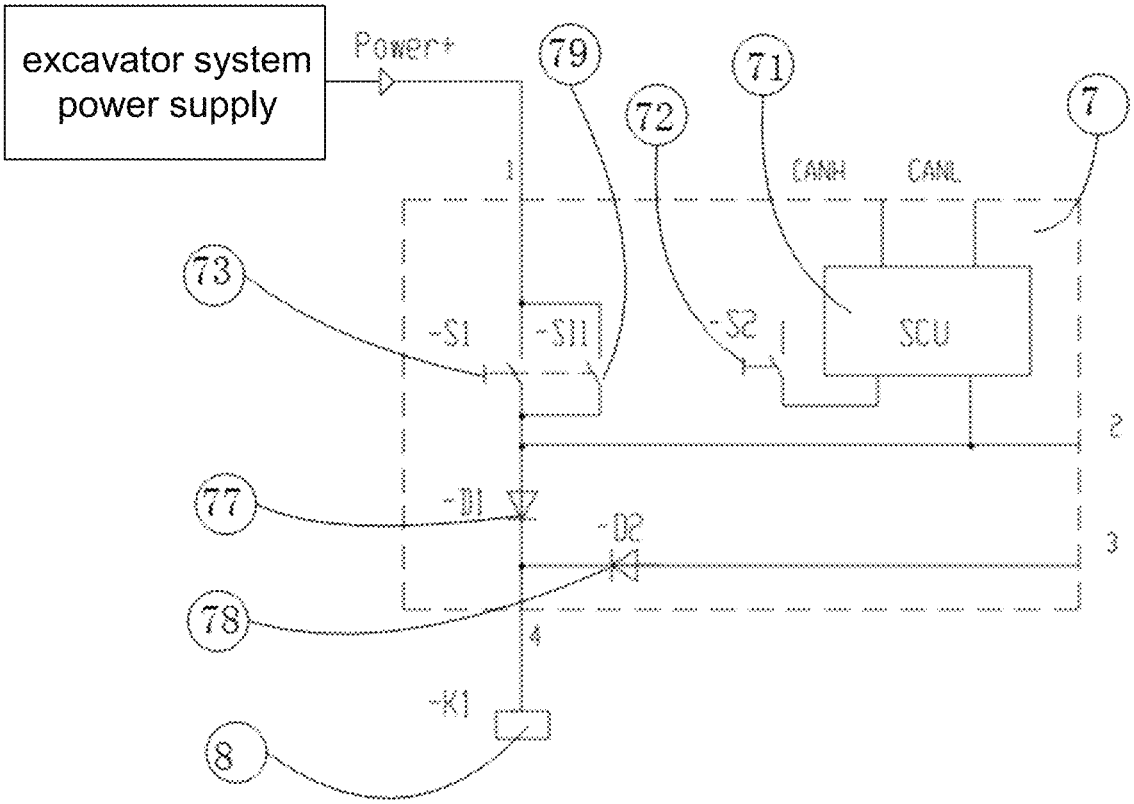
FIG. 4 is a schematic diagram of a power redundancy control circuit for an integrated switch panel in an embodiment of the invention.
Figure 5:
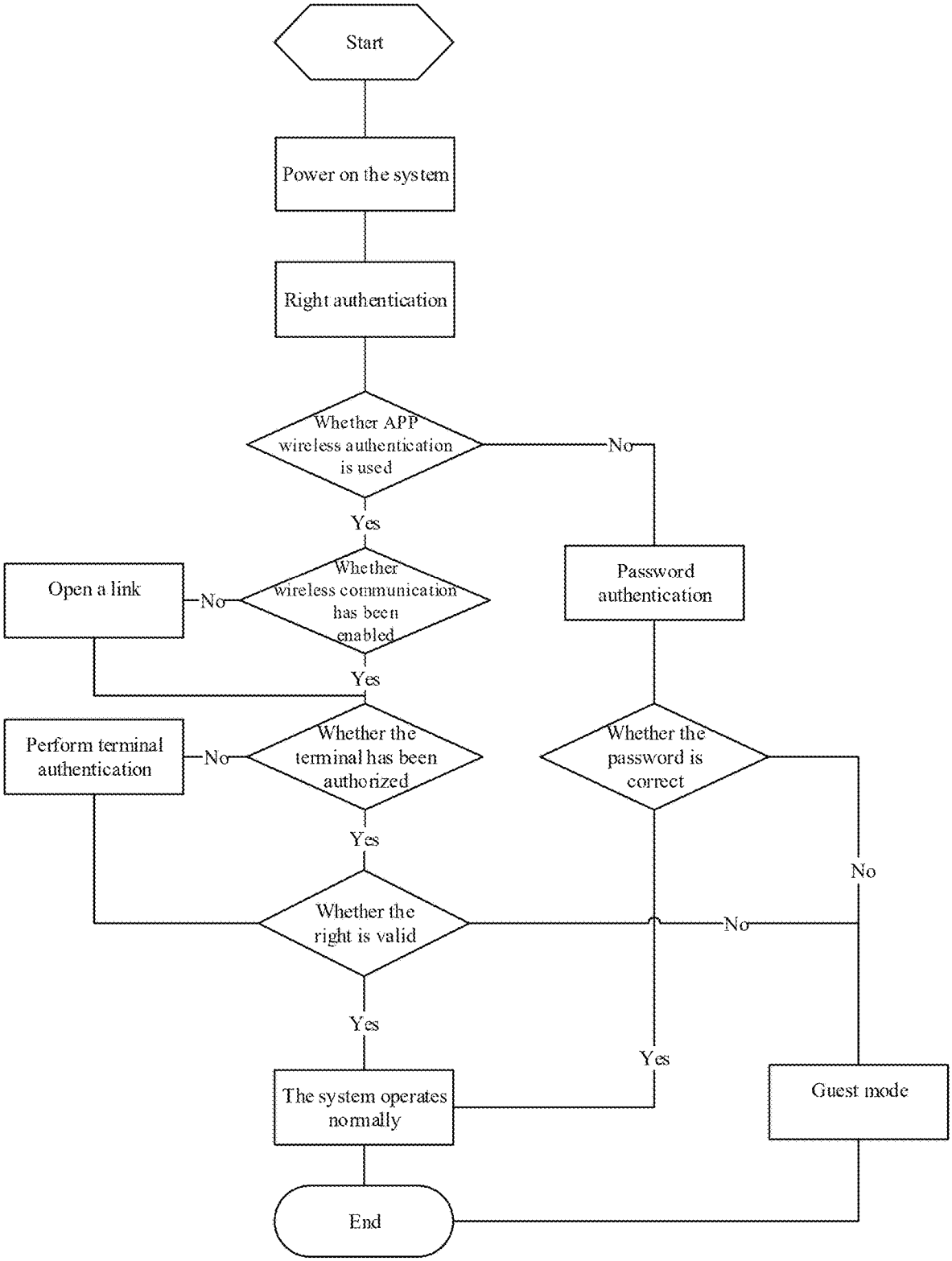
FIG. 5 is a flowchart of start-stop control in an embodiment of the invention.

With reference to FIGS. 1-4, when a button of the power switch 73 of the integrated switch panel 7 is pressed, the system power reaches the power supply relay 8 after passing through the first diode 77, so that the coil of the power supply relay 8 is energized and the system is powered on. At this point, the main controller 10 is powered on to work, and a DI port of the main controller may acquire the closing signal of the power switch 73 transmitted from a port 2 of the integrated switch panel 7 or the closing signal of the power switch 73 transmitted through a bus (such as the CAN bus in FIG. 3). If the main control system 10 determines that the bus communication is normal, the system will assess the switch status of the power switch 73 from the bus; if the bus communication is abnormal, the main controller receives the closing signal of the power switch 73 transmitted through the port 2 of the integrated switch panel 7, as shown in FIG. 4, where the other end of the power switch is connected to a pin of the switch control unit 71 and the port 2 of the integrated switch panel 7, and the port 2 of the integrated switch panel 7 is connected to the first pin of the main controller.

If the switch status is closed, the main controller 10 outputs a high level equivalent to the system power through a DO port, and reaches the power supply relay 8 after passing through the second diode 78, so that the coil of the power supply relay 8 is energized for maintaining the power supply after the power switch 73 is turned off. If the bus is abnormal, the system uses a redundancy control mechanism to further assess the power switch signal transmitted from the integrated switch panel 7 and acquired by the main controller 10, so as to enable power supply. Similarly, redundancy control is also used when power is cut off, and the reliability of system power control can be improved through redundancy control.

In a specific embodiment, according to the actual application scenarios and application requirements, the main controller can be used to make logical assessments and output signals to the starting unit and the engine control module, to realize different startup and shutdown modes. For example, in response to the main controller determining that the status of the power switch is off, the second output pin of the main controller stops outputting the high level after a predetermined delay time, so as to control a power holding time of an excavator system after the power switch is off. Based on the results of the excavator start-stop control system provided in this application, those skilled in the art can determine the control logic in specific applications, which will not be described in detail in this application.

Embodiment 3: Based on Embodiment 1, this embodiment provides a control method of the excavator start-stop control system. Referring to FIGS. 1-5, the control method comprises:

after the system is powered on, the electronic monitor 6 enters an authentication prompt state; the authentication interface contains APP wireless authentication and password authentication based on the mobile terminal 4; when wireless authentication is performed for the first time, the system automatically enables wireless communication, and the operator may use a factory password for mobile terminal 4 pairing; after downloading an APP, the operator uses an administrator password of the mobile terminal to register and bind the APP to an excavator; the authentication interface allows selection between APP automatic authentication and password login authentication; if the operator prefers not to authenticate, the page also offers a guest login option, which limits the usage rights of the machine, including but not limited to prohibiting the starting of the machine.

Operators may obtain a link to download the APP through a QR code on a registration page of the electronic monitor 6 or download it from the company's global website. The system also supports downloading the APP from the Android and Apple app stores.

When binding the APP to the mobile terminal, operators may utilize a built-in biometric system 3 of the mobile terminal 4, such as fingerprint identification or facial identification system, to enable biometric identification, thereby simplifying the authentication process during APP login.

The electronic monitor 6 will automatically enable wireless settings to support wireless APP authentication when it is turned on, and will turn off the wireless settings when the authentication is completed, thus reducing the radio frequency power consumption. Further, the system may also automatically start the mobile APP through wireless communication, and complete the verification in the background, thus improving the verification efficiency.

The system also supports grace period setting. If the time between two power-on operations of the machine is less than a grace period, the system will not require authentication for the next power-on operation. Both the grace period setting and the activation of the grace feature may be configured through an instrument.

Further, operators may select "Forgot Password" on the authentication page, and the electronic monitor 6 will navigate from the authentication interface to a dynamic password login and security question login interface. Upon successful login, the system will enter a password modification interface, allowing operators to change their passwords within their permission scope. If the operator has owner privileges, they can modify their own password as well as the passwords of all operators. If the operator has operator privileges, they can only change their own password.

When the owner (operator) forgets the password, the system supports modifying the administrator password in the electronic monitor 6. During the password modification process, the system allows the use of security question prompts and dynamic passwords to access the password modification interface. The owner may obtain a dynamic password using a verification code displayed on the electronic monitor 6 in conjunction with the dynamic password generator software developed by the manufacturer. The owner may also enter the corresponding password modification interface after authenticating through a pre-bound mobile terminal 4.

If the owner forgets the password, they may be notified to modify it, use the security question prompt to access the password modification interface, or authenticate through a pre-bound mobile terminal to enter the relevant password modification interface.

Further, if the machine authentication is incorrect, the system will enter a guest mode, restricting the ability to start the machine. When the operator is authenticated correctly, the machine will transition to a normal login mode, allowing the operator to initiate the startup using the one-touch start switch 72 on the integrated switch panel 7. When the operator presses this button, the machine will begin the startup process, with the main controller 10 outputting a high level through the DO port connected to a KeySW port of the engine control module 2. If the operator does not release the start button before a power system has fully started, the main controller will energize the starting relay K2 until the startup process is finished. If the system still cannot start before the maximum allowed startup duration, the DO port will stop outputting a high level to prevent damage to a starting motor from prolonged starting attempts.

When the machine is allowed to start, the start operation indicator light 76 on the integrated switch panel 7 displays green, and if the machine is forbidden to start, the yellow start protection indicator light 75 will light up.

Further, if the operator presses the one-touch start switch 72 again after the machine has started, the main controller 10 will stop the high level output through the DO port connected to the KeySW port of the engine control module 2. The engine will enter a shutdown state in a predetermined mode. The operator may set shutdown delay parameters in the electronic monitor 6 to accommodate different shutdown duration requirements. At this point, the system remains powered on.

Further, if the operator presses the power switch 73 on the integrated switch panel 7 after the engine has shut down, the system will enter a delayed power-off state. The power-off delay duration may be configured in the electronic monitor 6, or non-delayed power-off control may be used to achieve immediate power cut, and pressing this switch will result in an immediate power-off state.

If the machine has not entered the shutdown state and the operator operates the power switch 73 on the integrated switch panel 7, the system will simultaneously power off and shut down. Additionally, if the system experiences an abnormal shutdown, the operator may also achieve an emergency shutdown by using the emergency stop switch.

The excavator start-stop control system provided by the invention achieves dual-button separation control through the use of the power switch and the one-touch start switch. This not only simplifies the structural complexity of traditional one-touch start modules but also allows for the separation of engine start-stop and power-on functions. The system utilizes power-on hold technology to achieve intelligent control of the power supply after a reset, enabling flexible configuration of shutdown and power disconnection. Additionally, the system allows for emergency power cut through combined operations of a start-stop button, enhancing the safety of machine usage. The system improves the convenience of authentication through parallel authentication using an APP and password permissions, while also enhancing authentication efficiency via automatic authentication in the background of the APP based on biometrics.

The above are only preferred embodiments of the invention, and it should be pointed out that for those of ordinary skill in the art, without departing from the principle of the invention, several improvements and refinements can be made, and these improvements and refinements should also be considered within the scope of protection of the invention.

The specific embodiments of the invention have been described in detail above, but they are only examples, and the invention is not limited to the specific embodiments described above. It will be obvious to those skilled in the art that any equivalent modifications and substitutions are also within the scope of the invention. Therefore, all equivalent transformations and modifications made without departing from the spirit and scope of the invention should be included in the scope of the invention.

What is claimed is:

1. An excavator start-stop control system, comprising:

a main controller, an integrated switch panel, an engine starting unit, and an engine control module;

wherein the integrated switch panel is provided with a switch control unit, a one-touch start switch and a power switch, one end of the power switch is connected with a positive pole of an excavator system power supply, the other end is connected with a coil of a power supply relay through a first diode, and the other end of the power switch is also connected with a pin of the switch control unit and a first pin of the main controller;

a second output pin of the main controller is connected to the coil of the power supply relay through a second diode to control an on-off of the excavator system power supply; and a third output pin of the main controller is connected with a coil of a starting relay to control the engine starting unit, and the main controller is connected with the engine control module and the switch control unit through buses, respectively.

2. The excavator start-stop control system according to claim 1, wherein a fourth output pin of the main controller is connected to the engine control module through an emergency stop switch.

3. The excavator start-stop control system according to claim 1, wherein the integrated switch panel is further provided with a power operation indicator light, a start protection indicator light and a start operation indicator light.

4. The excavator start-stop control system according to claim 1, wherein the power switch adopts a single-contact structure or a dual-contact redundant structure.

5. The excavator start-stop control system according to claim 1, further comprising:

a mobile terminal which communicates with the main controller through a communication module and is used for authenticating the identity of an operator.

6. The excavator start-stop control system according to claim 5, further comprising:

an electronic monitor, the mobile terminal is connected with the main controller through the electronic monitor, and the electronic monitor is used for setting and displaying an authentication interface.

7. The excavator start-stop control system according to claim 5, further comprising:

a biometric unit, the biometric unit is integrated with the mobile terminal or the mobile terminal is connected with the main controller through the biometric unit, and the biometric unit is used for biometric identification of an identity card of the operator.

8. A control method using the excavator start-stop control system according to claim 1, comprising:

closing the power switch, the coil of the power supply relay is energized, and acquiring a power switch status signal by the main controller, wherein if the status of the power switch is closed, an output of the second output pin of the main controller is equivalent to a high level of the excavator system power supply, and reaches the power supply relay through the second diode, so that the coil of the power supply relay is continuously energized.

9. The control method according to claim 8, wherein acquiring the power switch status signal by the main controller comprises:

if bus communication between the main controller and the switch control unit is normal, the main controller receives the power switch status signal sent by the switch control unit through the bus; and if the bus communication between the main controller and the switch control unit is abnormal, the main controller uses the first pin to acquire the power switch status signal.

10. The control method according to claim 8, further comprising:

in response to the main controller determining that the status of the power switch is off, the second output pin of the main controller stops outputting the high level after a predetermined delay time, so as to control a power holding time of an excavator system after the power switch is turned off.

11. The control method according to claim 8, wherein the excavator start-stop control system further comprises:

a mobile terminal and an electronic monitor, wherein the mobile terminal communicates with the main controller through a communication module, and the mobile terminal is used for authenticating the identity of an operator; the mobile terminal is connected with the main controller through the electronic monitor, and the electronic monitor is used for setting an authentication interface; and wherein the control method further comprises:

after the excavator power system is powered on, initiating an authentication prompt state, wherein the authentication interface on the electronic monitor contains APP wireless authentication and password authentication based on the mobile terminal;

wherein when wireless authentication is performed for the first time, wireless communication is enabled, and the operator uses a factory password for mobile terminal pairing; after downloading an APP, the operator uses an administrator password of the mobile device to register and bind the APP to an excavator;

wherein the authentication interface allows selection between APP wireless authentication and password login authentication;

wherein the authentication interface provides an option for guest login, which limits the usage rights of the excavator during guest access.

* * * * *